US006050469A

United States Patent [19]

Brabant et al.

[11] Patent Number: 6,050,469

[45] **Date of Patent: *Apr. 18, 2000**

[54] SUCTION CYLINDER WHICH TRANSFERS FIBER WEB FROM A CONVEYER BELT TO TWO CALENDERING CYLINDERS

[75] Inventors: Marc Brabant, Hem; Jean-Louis Dupont, Tourcoing, both of France

[73] Assignee: Thibeau Et Cie, Tourcoing, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/615,605

[22] Filed: Mar. 13, 1996

[30] Foreign Application Priority Data

Mar. 22, 1995 [FR] France ..... 95 03573

[51] Int. Cl.[7] ..... B65H 20/00

[52] U.S. Cl. ..... 226/183; 226/95; 226/190

[58] Field of Search ..... 226/95, 183, 190

[56] References Cited

U.S. PATENT DOCUMENTS

| | | | |
|---|---|---|---|
| 1,519,985 | 12/1924 | Simmons | 226/95 |
| 3,112,054 | 11/1963 | Fleissner | 226/95 |
| 3,780,960 | 12/1973 | Tokuno et al. | 226/95 X |
| 3,822,166 | 7/1974 | Anderson | 226/95 X |
| 5,518,490 | 5/1996 | Ziegelhoffer | 226/95 X |

FOREIGN PATENT DOCUMENTS

| | | |
|---|---|---|
| 0155656 | 9/1985 | European Pat. Off. . |
| 0282996 | 9/1988 | European Pat. Off. . |
| 0081287 | 7/1963 | France . |
| 1500746 | 9/1967 | France . |
| 2612949 | 9/1988 | France . |
| 1241319 | 5/1967 | Germany . |

*Primary Examiner*—Daniel P. Stodola
*Assistant Examiner*—Gregory J. Strimbu
*Attorney, Agent, or Firm*—Ladas & Parry

[57] ABSTRACT

A fiber web transferring device comprising a conveyor belt, a suction cylinder, a lower calendering cylinder and an upper calendering cylinder. The suction cylinder having a stationary suction sector and rotates in a direction which corresponds to a linear moving direction of the conveyor belt. The suction cylinder transfers a non-consolidated fiber web from the conveyor belt to the lower calendering cylinder and is substantially tangential to the lower calendering cylinder so as to cooperate therewith to define a pre-calendering zone for the fiber web. The suction cylinder is positioned such that the suction cylinder sucks the fiber web from the conveyor belt and holds the fiber web against the outer surface of the suction cylinder to the pre-calendering zone. The fiber web then adheres to the outer surface of the lower calendering cylinder past the pre-calendering zone until the fiber web reaches the upper calendering cylinder.

4 Claims, 1 Drawing Sheet

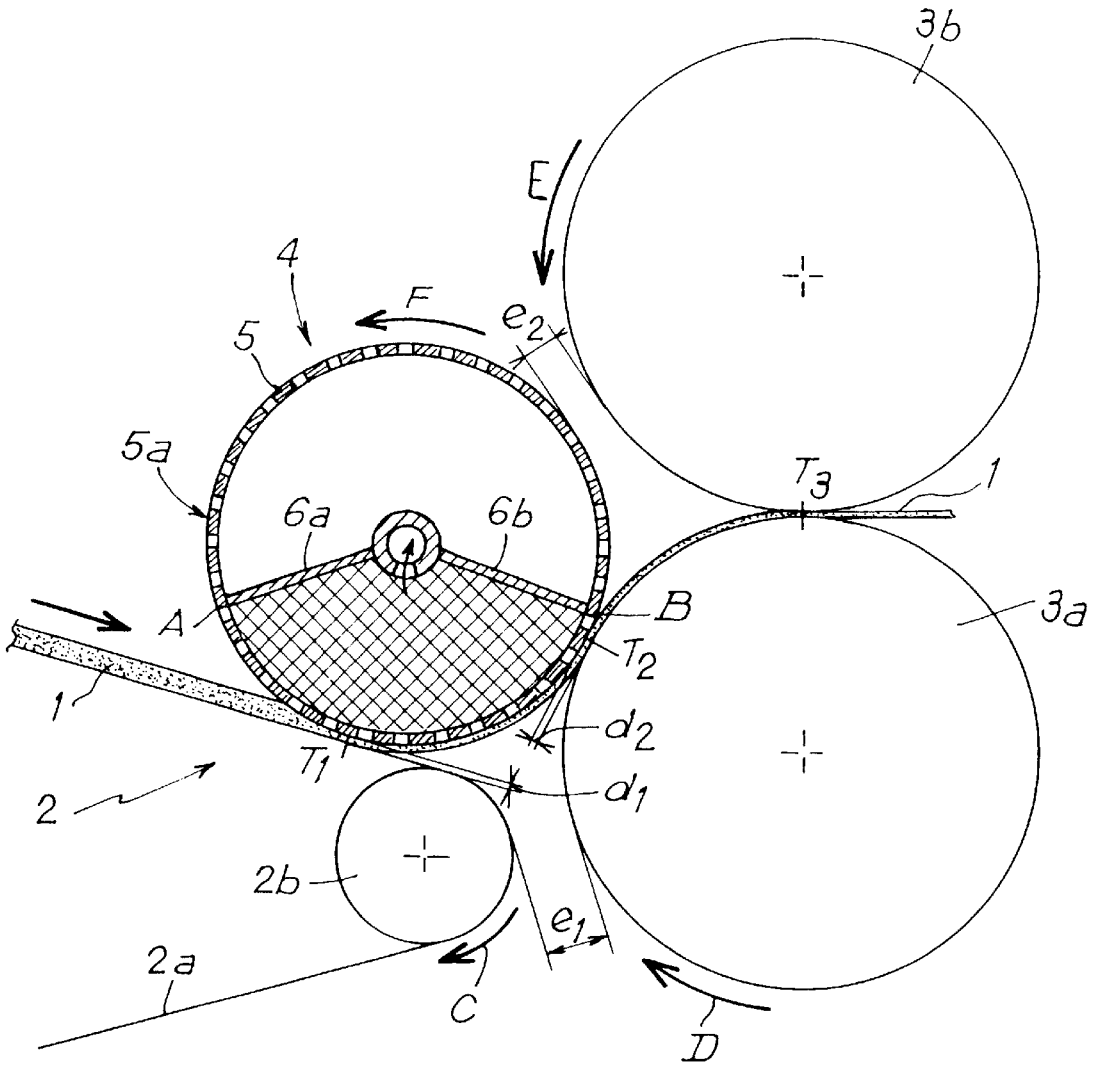
3b
E
4
F
e2
5
5a
T3
1
6a
6b
A
B
3a
T2
1
d2
T1
d1
2
2b
e1
2a
C
D

SUCTION CYLINDER WHICH TRANSFERS FIBER WEB FROM A CONVEYER BELT TO TWO CALENDERING CYLINDERS

The present invention relates to transferring a fiber web from a conveyor belt to two calendering cylinders. More particularly, it relates to a novel use of a suction cylinder for performing such a transfer. The invention is particularly applicable to conveyor belts interposed between the outlet of a carder and the calendering cylinders.

BACKGROUND OF THE INVENTION

It is conventional for a fiber web leaving a carder to be conveyed to the calendering cylinders for consolidating the web by means of a conveyor belt. Until now, the fiber web has been transferred from the conveyor belt to the two calendering cylinders by the web being taken up directly by the calendering cylinders, with the conveyor belt extending so as to be tangential to the two calendering cylinders.

On being transferred, and while in the intermediate zone between the conveyor belt and the calendering cylinders, the web is unsupported, and that is harmful to its cohesion. In addition, in the intermediate zone, the conveyor belt and the calendering cylinders generate air turbulence because they are in motion, and the greater the speed of the conveyor belt and of the calendering cylinders, the greater the turbulence, which gives rise to an increased risk of transverse creases forming in the web while it is being transferred.

In order to reduce the effects of air turbulence on the web, European patent application EP 0 155 656 has already proposed compressing the web prior to transferring it. In a particular variant embodiment described in that European patent application, use is made of a hollow perforated rotary cylinder which is positioned above the conveyor belt, upstream from the two calendering cylinders. When the web reaches the hollow cylinder, it is subjected to compression prior to being transferred, with the air initially contained in the fiber web escaping by passing through the perforated cylinder.

Such prior compression of the fiber web serves to attenuate the effects of the zone of turbulence, but it does not prevent the web being unsupported while it is being transferred.

In addition, in practice, it is necessary for the fiber web to be taken up directly at the outlet of the conveyor belt by the calendering cylinders while simultaneously being subjected to considerable stretching in the length direction of the fiber web, which stretching may be as great a 50% for linear speeds of the conveyor belt of the order of 100 meters per minute (m/min). Unfortunately, on leaving the carder and prior to being calendered, the fiber web has very little cohesion. Consequently, when it is stretched lengthwise, the cohesion of the web is reduced correspondingly. When the web is stretched too much, then a web is obtained that is of poor quality with respect to appearance, uniformity of weight, and isotropy of its mechanical properties. This drawback associated with web stretching is particularly critical with scrambled and/or condensed webs which have less longitudinal strength than do parallel webs.

The above-mentioned problems of the fiber web being unsupported and being stretched while it is being transferred put a limit on the speed at which the fiber web can be conveyed prior to being consolidated by the calendering cylinders. In practice, a web coming from a carder and not subject to intermediate consolidation treatment cannot be conveyed by a conveyor belt and taken up directly by calendering cylinders at a speed greater than 120 m/min.

OBJECT AND SUMMARY OF THE INVENTION

The object of the present invention is to provide a device for transferring a fiber web from a conveyor belt to two calendering cylinders that enables the above-specified problems to be resolved.

According to the invention, the transfer device comprises a suction cylinder which includes a stationary suction sector, which is rotated in the same direction as the conveyor belt and in the opposite direction to the lower calendering cylinder. The suction cylinder is interposed on the path of the web between the conveyor belt and the two calendering cylinders, being tangential or substantially tangential to the lower calendering cylinder; in other words, the distance between the surface of the suction cylinder and the surface of the lower calendering cylinder is zero or less than the thickness of the web, so that between them the two cylinders define a pre-calendering zone within which the fiber web is subjected to compression causing it to adhere to the surface of the lower calendering cylinder. The suction cylinder is also positioned close to the conveyor belt so that the fiber web is pressed by suction against the surface of said cylinder, and is held thereon by suction until it reaches said pre-calendering zone. Beyond the pre-calendering zone, the fiber web is entrained on the surface of the lower calendering cylinder until it reaches the top calendering cylinder.

The above characteristics of the device of the invention make it possible to reduce stretching and to reduce the risk of the web being unsupported while it is being transferred, since the web is continuously pressed against the surface of the suction cylinder and then against the surface of the lower calendering cylinder. In addition, the suction cylinder and of the lower calendering cylinder rotate in opposite directions so transfer of the web from one of these two cylinders to the other advantageously takes place without the web being pushed back at any point, and consequently without any change in the structure of the fiber web.

The use of suction cylinders in the field of textiles is already widespread. In particular, it is known from French patent No. 1 500 746 to use a suction cylinder for detaching a fiber web at the outlet from a carder. French patent No. 2 612 949 teaches the use of at least two adjacent hollow perforated cylinders for consolidating a textile web or sheet. French certificate of addition FR 81 287 envisages using a suction condenser cylinder in an installation for manufacturing thread, for the purpose of eliminating the large drum that is usually used. Also, to facilitate take-up of the web from the periphery of the condenser cylinder, a suction detacher cylinder is used.

The present invention thus resides in the novel application of a suction cylinder that is otherwise known per se. According to the invention, the suction cylinder performs a novel function of transferring a fiber web from a conveyor belt to two calendering cylinders for the purpose of obtaining the above-specified results and advantages.

In the ambit of the invention, it is possible to position the suction cylinder at a level flush with the end portion of the conveyor belt, and in line with said belt. However, that variant suffers from the drawback of running the risk of the fiber web being unsupported on passing from the conveyor belt to the surface of the suction cylinder. That is why, in a preferred embodiment of the invention, the suction cylinder is tangential or substantially tangential to the conveyor belt, thereby enabling the fiber web to be compressed between those two members. This avoids any risk of the web being unsupported while it is being transferred.

BRIEF DESCRIPTION OF THE DRAWING

Other characteristics and advantages of the invention appear more clearly on reading the following description of a preferred embodiment of the invention, which description if given by way of non-limiting example and is made with reference to the accompanying drawing in which the sole FIGURE is a illustrative diagram of a suction cylinder positioned over the end portion of a conveyor belt.

MORE DETAILED DESCRIPTION

As can be seen in, the particular example shown in the FIGURE, a non consolidated fiber web 1 from a carder (not shown) is conveyed by a conveyor belt 2 to the vicinity of two heating calendering cylinders 3*a* and 3*b*. In conventional manner, the surfaces of the calendering cylinders 3*a* and 3*b* are raised to a temperature that is close to the softening temperature of the fibers of the web, so as to heat-bond the fibers together by compression and by heating as the web passes between the two calendering cylinders. The conveyor belt 2 comprises, in conventional manner, an endless belt 2*a* tensioned between drums (only one drum 2*b* illustrated) that are rotated. The belt 2*a* is impermeable to air and may be made of polypropylene, for example. In the figure, only the end portion of the conveyor belt in the vicinity of the two calendering cylinders 3*a* and 3*b* is shown.

In accordance with the invention, the fiber web 1 is transferred from the conveyor belt 2 to the two calendering cylinders 3*a* and 3*b* by means of a suction cylinder 4. In the example shown, this cylinder is hollow having a perforated peripheral wall 5. Inside the cylinder, there are provided two stationary partitions 6*a* and 6*b* which between them define a suction sector AB represented in FIG. 1 by cross-hatching. The application of suction to a sector as defined by the partitions 6*a* and 6*b* is known and is therefore not described in detail. For implementation purposes, reference may be made to French patent No. 1 500 746, which forms an integral portion of the present description.

The suction cylinder 4 is substantially tangential firstly at point $T_1$ to the belt 2*a* of the conveyor 2, and is substantially tangential secondly at point $T_2$ to the lower calendering cylinder 3*a*. In addition, the suction cylinder 4 is driven positively to rotate in the direction of arrow F so that its peripheral speed is substantially equal to the linear speed at which the fiber web 1 is conveyed by the conveyor 2. The two calendering cylinders 3*a* and 3*b* are rotated in opposite directions, with the direction of rotation of the lower cylinder 3*a* also being opposite to the direction of rotation of the suction cylinder 4.

The distance $d_1$ between the surface 5*a* of the peripheral wall 5 of the suction cylinder 4 and the belt 2*a* of the conveyor 2 at the point $T_1$ where they meet tangentially is selected to be small enough for the fiber web 1 to be compressed as it passes from the conveyor 2 to the suction cylinder 4. During this compression, air contained in the web escapes through the perforations in the wall 5.

Between them, the suction cylinder 4 and the lower calendering cylinder 3*a* define a pre-calendering zone for the fiber web, on either side of the point $T_2$. In this pre-calendering zone, the fibers of the web are subjected to a small amount of softening under the combined effects of compression and of heating. The distance $d_2$ between the surface 5*a* of the peripheral wall 5 of the cylinder 4 and the surface of the lower calendering cylinder 3*a* at the point $T_2$ is small enough to ensure that the fiber web adheres to the surface of the lower calendering cylinder 3*a* beyond the point $T_2$ under the combined effects of heating and compression. In practice, the peripheral wall 5 of the suction cylinder 4 is made of perforated metal sheet, and is therefore not damaged by the heating and the compression.

The web 1 is transferred from the conveyor belt 2 to the calendering cylinders 3*a* and 3*b* in the following manner. In a zone centered about the point $T_1$, the fiber web is subjected to compression between the belt 2*a* and the suction cylinder 4. On leaving this compression zone, the fiber web 1 is pressed against the periphery of the suction cylinder 4 under the effect of the suction air flow generated in the sector AB, and it is driven by the suction cylinder 4 in rotation until it reaches the pre-calendering zone centered on the point $T_2$. Between the points $T_1$ and $T_2$, the web is constantly held by suction to the periphery of the cylinder 4. The points A and B corresponding to the beginning and to the end of the suction cylinder in the example shown are located respectively upstream from the point $T_1$ and downstream from the point $T_2$ relative to the travel of the web 1. At the outlet from the pre-calendering zone, the fiber web adheres to the surface of the lower calendering cylinder 3*a* and it is conveyed by said cylinder to the calendering point $T_3$.

In the example shown, the point A which marks the beginning of the suction sector of the cylinder 4 is situated, relative to the travel direction of the web, upstream of the tangential point $T_1$ so that the suction air flow facilitates extraction of the air contained in the web while it is being compressed between the suction cylinder 4 and the belt 2*a* of the conveyor 2. However the invention is not limited to this feature. The partition 6a could be disposed so that the point A coincides with the point $T_1$, and it could even be positioned slightly downstream from said point, while nevertheless preferably remaining in the web compression zone. In the same manner, the end of the suction sector (B) could coincide with the point $T_2$, or could indeed be located slightly upstream of said point, while nevertheless preferably remaining in the web pre-calendering zone. In order to enable the shape of the suction sector to be varied, it is preferably possible to adjust the angular positions of the two partitions 6*a* and 6*b*.

In the above-described device of the invention, it is advantageous to avoid the web being unsupported on being transferred from point $T_1$ to point $T_3$. In addition, in the example shown, the relative positions of the three cylinders 3*a*, 3*b*, and 4, and of the conveyor belt 2 are suitably selected to limit the distance travelled by the web between the points $T_1$ and $T_2$, thereby increasing the reliability of web transfer. More precisely, the lower cylinder 3*a* is positioned relative to the suction cylinder 4 so as to reduce the distance between the points $T_1$ and $T_2$ to as small a distance as possible, while nevertheless retaining a sufficient gap $e_1$ to avoid creating a zone of turbulence in the intermediate zone between the suction cylinder 4, the conveyor belt 2, and the calendering cylinder 3*a*. The travel of the belt 2*a* of the conveyor 2 and the rotation of the lower calendering cylinder 3*a* give rise to oppositely-directed surface flows of air as referenced respectively arrows C and D in the figure. If the distance $e_1$ is very small, then these two flows of air give rise to turbulence in the web transfer zone and that could be harmful to the quality of the web. It is therefore up to the person skilled in the art to find a compromise between reducing the distance between the points $T_1$ and $T_2$, and maintaining a gap $e_1$ of sufficient size. Similarly, the calendering cylinder 3*b* is positioned relative to the suction cylinder 4 in such a manner as to limit the peripheral portion of the lower calendering cylinder 3*a* which is in contact with the fiber web between the webs $T_2$ and $T_3$ while nevertheless conserving a gap $e_2$ which is sufficient to avoid creating a zone of turbulence at the intersection between the three cylinders, because of the oppositely-directed surface flows of air generated by rotation of the cylinders 4 and 3*b* (arrows E and F).

In a particular embodiment, the diameter of the suction cylinder 4 is 290 mm, and the diameter of both calendering cylinders 3*a* and 3*b* is 350 mm. $e_1$ is 35 mm, $e_2$ is 25 mm, the distance $d_1$ is zero, and the distance $d_2$ is 0.3 mm. The peripheral speed of the two calendering cylinders 3*a* and 3*b* is 250 m/min. The peripheral speed of the suction cylinder 4 is identical to the travel speed of the belt 2*a* and is 217 m/min. In that embodiment the fiber web is transferred from the conveyor belt to the two calendering cylinders with stretching of about 15%.

The invention is not limited to the preferred embodiment described above. Within the ambit of the invention, it is possible to omit compression of the web between the suction cylinder 4 and the conveyor belt 2*a*. In addition, the suction cylinder 4 is not necessarily positioned over the conveyor belt 2*a* as shown in FIG. 1, but it could, for example, be placed directly downstream from the drive drum 2*b* so that the portion of its periphery corresponding to the suction sector AB is substantially in line with the fiber web reaching the drum 2*b*. Finally, the suction cylinder 4 may, in general, be constituted by any cylinder whose peripheral case is permeable to air.

What is claimed is:

1. In combination, a non-consolidated fiber web and a device which transfers the non-consolidated fiber web, wherein said device comprises: a linear movable conveyor belt which carries and conveys the non-consolidated fiber web into a triangular-shaped array of closely adjacent cylindrical rollers wherein said triangular-shaped array of rollers consists of a lower heated calendering cylinder rotatable in a first direction, an upper calendering cylinder rotatable in a second direction wherein said second direction is opposite the first direction, and a suction cylinder having a suction sector which applies suction to the non-consolidated fiber web upstream of the lower calendering cylinder, said suction cylinder being substantially flush with said conveyor belt and being rotatable in a direction corresponding to a linear moving direction of said conveyor belt, said direction of rotation of said suction cylinder being opposite to said first direction of rotation, said suction cylinder further being substantially tangential to said lower calendering cylinder at a point which defines a pre-calendering zone, so that as the non-consolidated fiber web is transferred from said conveyor belt to said lower calendering cylinder, the non-consolidated fiber web passes between said suction cylinder and said conveyor belt where the non-consolidated fiber web is pressed, and is held against said suction cylinder by suction effect and driven in rotation to said pre-calendering zone, the non-consolidated fiber web being compressed by the suction cylinder and lower calendering cylinder as the fiber web passes through the pre-calendering zone, the non-consolidated fiber web adhering to the lower calendering cylinder under combined effects of heating and compression, so that the non-consolidated fiber web is entrained by the lower calendering cylinder up to said upper calendering cylinder.

2. The combination of claim 1, wherein the suction cylinder is substantially tangential to the conveyor belt.

3. The combination of claim 1, wherein the lower calendering cylinder is positioned relative to the suction cylinder and to the conveyor belt in such a manner that a portion of the suction cylinder, which holds the non-consolidated fiber web, is as small as possible, while a gap established between the lower calendering cylinder and the conveyor belt is sufficiently great enough to avoid creating turbulence that would damage the non-consolidated fiber web disposed between the suction cylinder, the conveyor belt and the lower calendering cylinder.

4. The combination of claim 1, wherein the suction cylinder and the two calendering cylinders are arranged in such a manner that a portion of the lower calendering cylinder in contact with the non-consolidated fiber web beyond the pre-calendering zone is as small as possible, while a gap is provided between the suction cylinder and the upper calendering cylinder sufficiently large enough to avoid creating turbulence that would damage the non-consolidated fiber web disposed between the suction cylinder, and the upper and lower calendering cylinders.

* * * * *